US008302937B2

(12) United States Patent
Mettler et al.

(10) Patent No.: US 8,302,937 B2
(45) Date of Patent: Nov. 6, 2012

(54) PEDESTRIAN BARRICADE ASSEMBLY

(75) Inventors: Charles M. Mettler, Perry, OH (US); Gregory H. Brown, Stow, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 276 days.

(21) Appl. No.: 12/611,477

(22) Filed: Nov. 3, 2009

(65) Prior Publication Data

US 2011/0101296 A1 May 5, 2011

(51) Int. Cl.
*E04H 17/16* (2006.01)

(52) U.S. Cl. ..... 256/26; 256/60; 256/65.06

(58) Field of Classification Search ..... 256/DIG. 2, 256/DIG. 4, DIG. 6, 26, 67, 65.06, 65.11, 256/60; 160/35–36; 16/86.1, 86.2
See application file for complete search history.

(56) References Cited

U.S. PATENT DOCUMENTS

| | | | | | |
|---|---|---|---|---|---|
| 2,051,407 | A | * | 8/1936 | Jones | 411/548 |
| 2,563,960 | A | * | 8/1951 | Reymann | 16/248 |
| 3,089,682 | A | | 5/1963 | Parker | |
| 3,268,252 | A | * | 8/1966 | Rolland | 403/296 |
| 3,799,507 | A | | 3/1974 | Rizzo | |
| 3,986,316 | A | * | 10/1976 | Blodee | 403/218 |
| 4,071,224 | A | | 1/1978 | Gilbert | |
| 4,231,676 | A | | 11/1980 | Smith et al. | |
| 5,030,029 | A | | 7/1991 | Johnsen | |
| 5,287,909 | A | * | 2/1994 | King et al. | 160/135 |
| 5,302,039 | A | * | 4/1994 | Omholt | 403/218 |
| 5,469,682 | A | * | 11/1995 | Knight | 52/718.01 |
| 5,544,870 | A | * | 8/1996 | Kelley et al. | 256/26 |
| 5,743,064 | A | * | 4/1998 | Bennett | 52/718.04 |
| 5,762,444 | A | | 6/1998 | Giannelli | |
| 5,863,030 | A | * | 1/1999 | Kotler et al. | 256/24 |
| 6,004,218 | A | * | 12/1999 | Keating et al. | 472/94 |
| 6,237,895 | B1 | | 5/2001 | Thurston | |
| 6,257,559 | B1 | | 7/2001 | Mouri | |
| 6,517,280 | B2 | | 2/2003 | Carter | |
| 6,651,724 | B1 | * | 11/2003 | Cittadini | 160/207 |
| 7,523,715 | B2 | | 4/2009 | Mettler et al. | |
| 7,540,682 | B1 | | 6/2009 | Christensen | |

OTHER PUBLICATIONS

ADDGARDS Pedestrian Barricade Systems—undated—admitted prior art (3 pages) enclosed.
International Search Report dated Dec. 23, 2010, Application No. PCT/US2010/054204 (enclosed).

* cited by examiner

*Primary Examiner* — Daniel P. Stodola
*Assistant Examiner* — Jonathan Masinick
(74) *Attorney, Agent, or Firm* — Renner, Otto, Boisselle & Sklar, LLP

(57) ABSTRACT

Pedestrian barricade assembly includes a plurality of uprights and associated guide rails. Each upright includes a front section having one or more transversely extending channels. Each of the channels has a pair of laterally spaced semicircular flanges in upper and lower side walls of the channels that are slidably engageable by upper and lower open notches adjacent end portions of the guide rails to provide hinge connections therebetween.

19 Claims, 8 Drawing Sheets

PEDESTRIAN BARRICADE ASSEMBLY

FIELD OF THE INVENTION

This invention relates generally to a pedestrian barricade assembly used to channelize pedestrians around construction or other work sites or for crowd control.

BACKGROUND OF THE INVENTION

Many different forms of barricades have been used for pedestrian traffic control, to alert the public to the existence of work and construction areas and to channelize pedestrians around and prohibit entrance into such areas. However, there is a continuing need for barricades of this type that are easy to set up and take down without the use of tools or fasteners, and that can also be adapted to a wide variety of construction and work areas of different sizes and shapes.

SUMMARY OF THE INVENTION

The pedestrian barricade assembly of the present invention includes a plurality of uprights and associated guide rails that are easily hingedly connectable to the uprights and just as easily disconnectable therefrom without the need for any tools or fasteners.

In accordance with one aspect of the invention, each upright includes one or more transversely extending channels each having a pair of laterally spaced semi-circular flanges on the upper and lower side walls of the channels, and each of the guide rails having upper and lower open notches adjacent end portions of the guide rails that are slidably engageable with the semi-circular flanges to provide hinge connections therebetween.

In accordance with another aspect of the invention, two pairs of laterally spaced semi-circular flanges may be provided on the upper and lower side walls of each of the channels for hingedly connecting one or two guide rails to each of the channels.

In accordance with another aspect of the invention, the semi-circular flanges may be part of bushings that may be fixedly attached to the upper and lower side walls of the channels.

In accordance with another aspect of the invention, the bushings may have raised ribs at entry points to recesses formed by the semi-circular flanges to provide some resistance to insertion and removal of end portions of the guide rails into and out of the recesses.

In accordance with another aspect of the invention, the semi-circular flanges may be integral with the upper and lower side walls of the channels.

In accordance with another aspect of the invention, each upright may have two vertically spaced, transversely extending channels each provided with two pairs of laterally spaced semi-circular flanges for hingedly connecting notched end portions of one or two guide rails to each of the channels to provide a barricade assembly with both top guide rails and bottom guide rails.

In accordance with another aspect of the invention, the uprights may be substantially in the shape of a right triangle including a substantially vertical front section to which the guide rails are hingedly connected, and a rear section extending rearwardly from the front section which is ballasted.

In accordance with another aspect of the invention, the rear section may be substantially hollow for receipt of flowable ballast material through a fill hole in an upper portion of the rear section.

In accordance with another aspect of the invention, the rear section may have a relatively large through opening for receipt of a sandbag.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and annexed drawings setting forth in detail certain illustrative embodiments of the invention, these being indicative, however, of but several ways in which the principles of the invention may be employed.

DETAILED DESCRIPTION OF THE INVENTION

Figure 1:
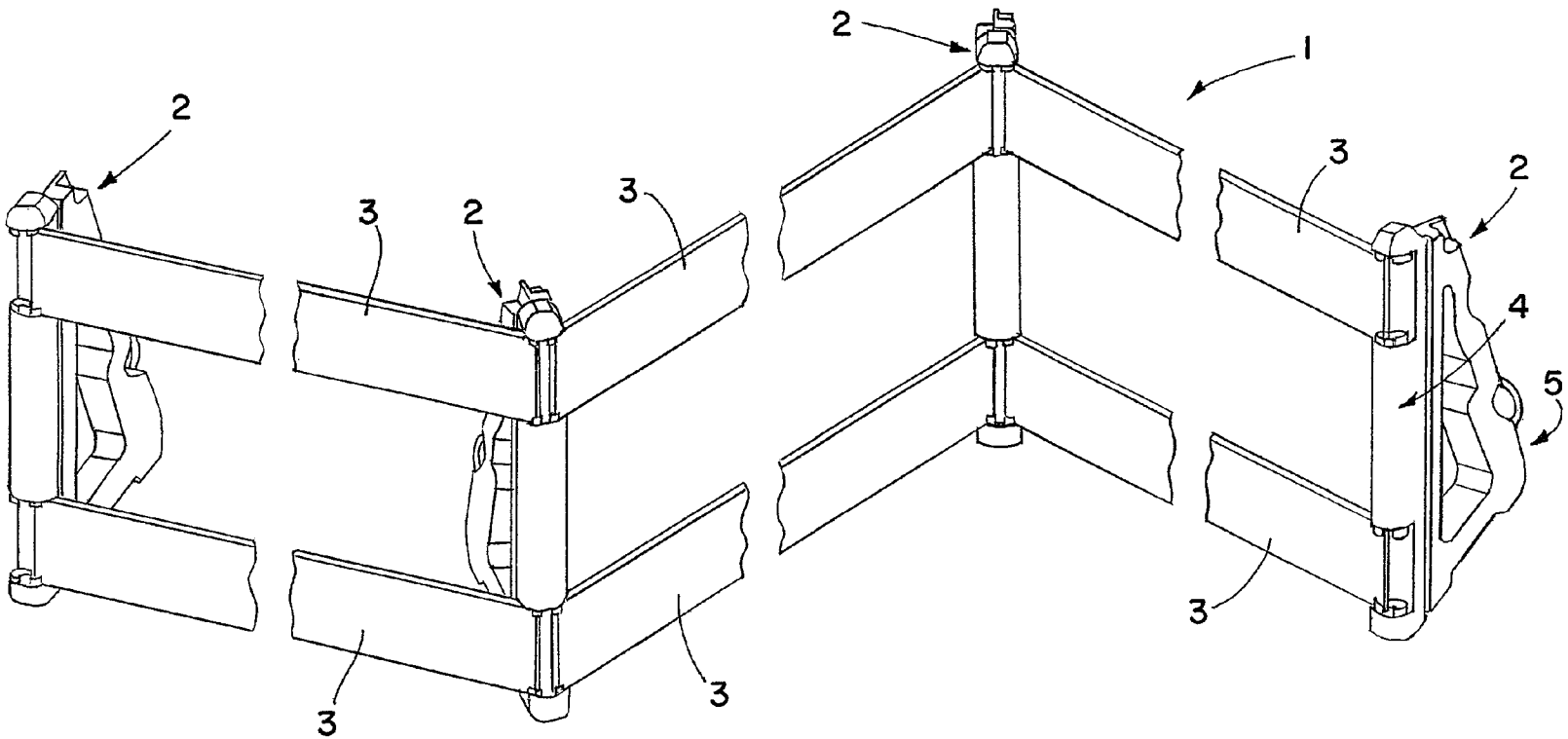
FIG. 1 is a schematic fragmentary perspective view of one form of pedestrian barricade assembly of the present invention.

Referring now in detail to the drawings, and initially to FIG. 1, there is shown one form of pedestrian barricade assembly 1 of the present invention which includes any number of uprights 2 and associated guide rails 3 extending therebetween with their ends hingedly connected to the uprights to permit limited angular adjustment of the guide rails relative to the uprights as needed to channelize pedestrians around different shaped construction or work areas and still provide a continuous pedestrian channelizer as described hereafter.

Figure 2:
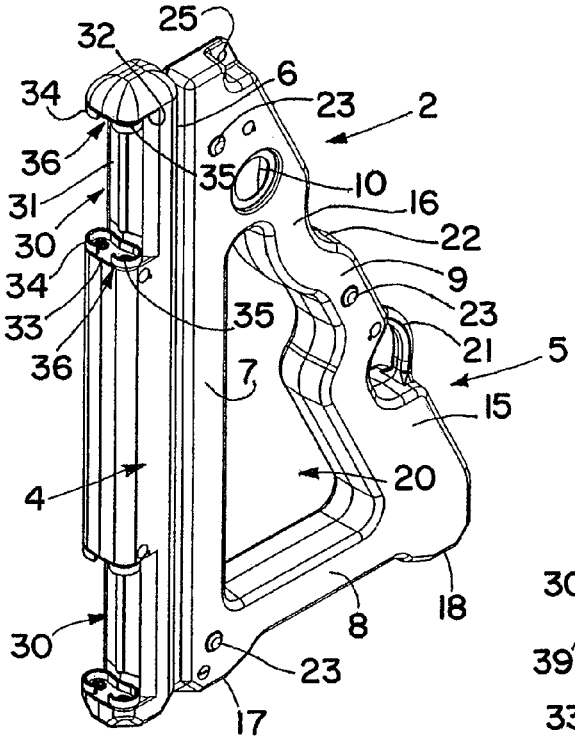
FIG. 2 is an enlarged perspective view of one of the uprights of the pedestrian barricade assembly of FIG. 1.

FIG. 2 shows one of the uprights 2, which are desirably substantially in the shape of a right triangle including a front section 4 that is substantially vertical when the guide rails are hingedly connected thereto as shown in FIG. 1 and a rear section 5 extending rearwardly from the front section which may be ballasted. Preferably the uprights 2 are substantially hollow and may be blow molded out of a suitable plastic such as high density polyethylene for added strength and relatively low cost.

A continuous tack off 6 may separate the front section 4 from the rear section 5, which may include substantially vertical and horizontal leg portions 7 and 8, and a rearwardly sloping leg portion 9 that may be filled with a suitable ballast material such as sand or water through a fill hole 10 near the top of the rear section. A removable plug 14 (see FIG. 17) may be used to close off the fill hole after filling the back section with a desired amount of ballast.

Figure 16:
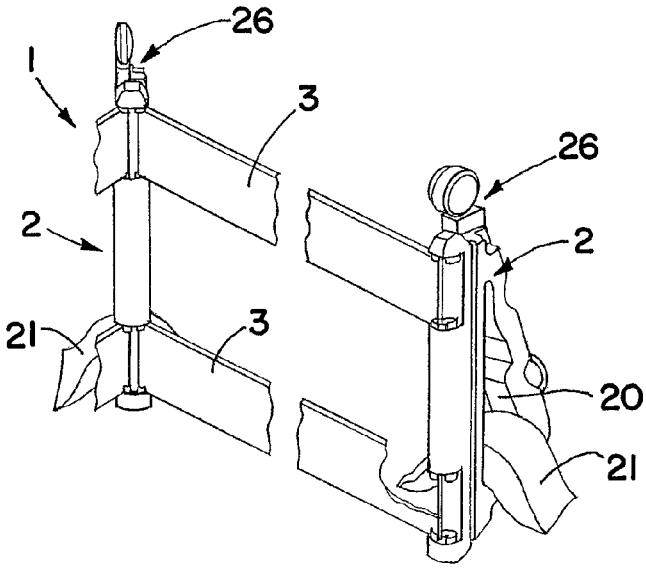
FIG. 16 is a fragmentary perspective view of a pedestrian barricade assembly of the present invention in which warning devices are shown attached to the tops of two uprights and sandbags are placed through openings in the uprights for ballast.

The back lower portion 15 of rear section 5 may have a larger volume than the upper portion thereof for receipt of more of the ballast material in the lower portion than the upper portion to provide a lower center of gravity for greater stability. Along the bottom edge of the rear section may be spaced apart front and rear pressure contact surfaces 17 and 18 to minimize rocking of the uprights on uneven surfaces. A relatively large right triangle shaped through opening 20 may be provided in the rear section of the uprights to reduce the amount of material required to mold the uprights and that is large enough to receive a sandbag 21 for use as ballast as schematically shown in FIG. 16.

Figure 18:
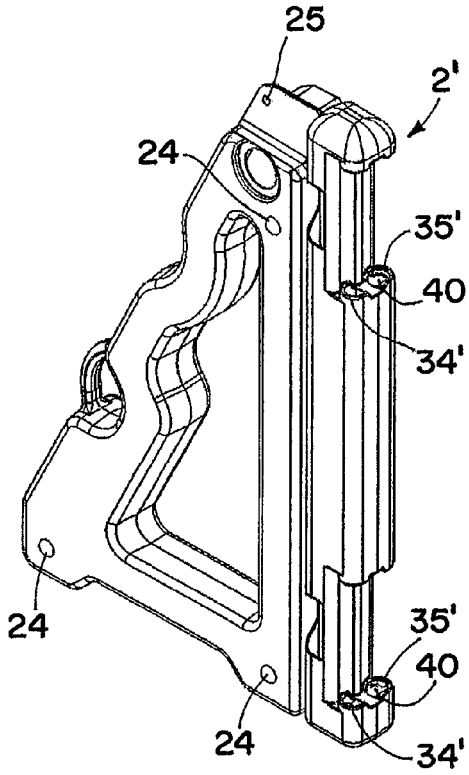
Figure 19:
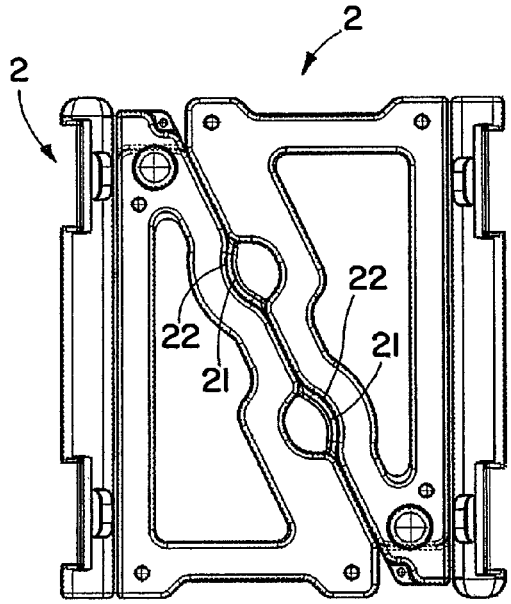
FIG. 19 is an enlarged perspective view showing two uprights of the present invention oriented 180° relative to one another and nested together along the angled back sides of the rear sections of the uprights with protruding handle sections on the back sides received in respective recesses in the other uprights for stacking the uprights in squares.

A carrying handle 21 may protrude from the back side of the rear section 5 for ease of lifting and transporting the uprights from one place to another. Also a recess 22 may be provided in the back side of the rear section in spaced relation from the protruding handle section 21 for receipt of the handle section of another upright when the other upright is oriented 180° relative to the one upright and the two uprights are placed back to back for stacking the uprights in squares as shown in FIG. 19. In addition, stacking bosses or ribs 23 may be provided on one side of the uprights for engagement in recesses 24 on the other side of the uprights (see FIGS. 17 and 18) for stacking of the uprights one on top of another. Mounting holes 25 may be provided in the top of the rear section 5 for mounting a suitable warning device 26 such as a light or motion activated recording (see FIG. 16).

Figure 3:
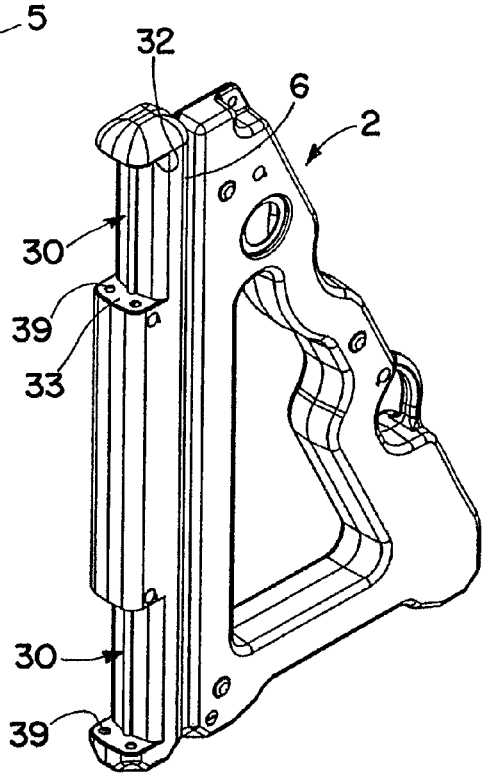
FIG. 3 is an enlarged perspective view of the upright of FIG. 2 prior to attachment of bushings to the upper and lower side walls of transverse channels in the front section of the upright as shown in FIG. 2 used to provide hinge connections between the upright and one or more guide rails.
Figure 4:
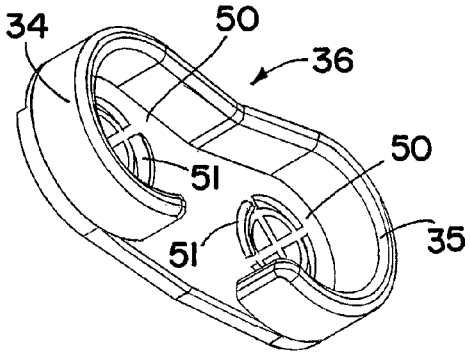
FIG. 4 is an enlarged perspective view of one of the bushings of FIG. 2 as seen from the top.
Figure 5:
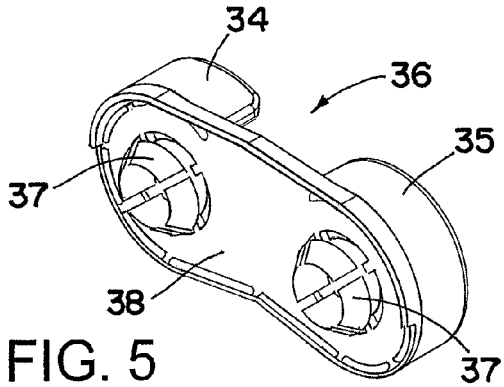
FIG. 5 is an enlarged perspective view of the bushing of FIG. 4 as seen from the bottom.
Figure 17:
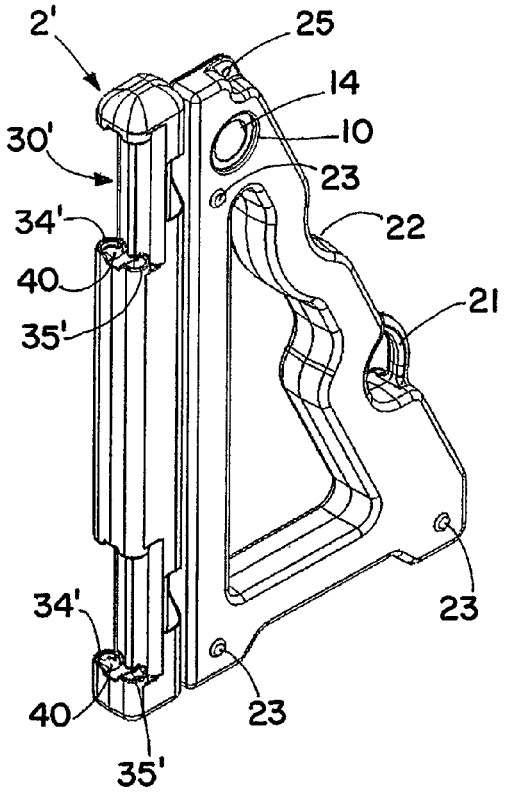
FIGS. 17 and 18 are enlarged perspective views of a modified form of upright of the present invention as seen from opposite sides thereof.

To facilitate attachment of the ends of the guide rails 3 to the uprights 2, the front section 4 of the uprights is desirably provided with one or more (preferably two) transversely extending channels 30. As shown in FIG. 2, each channel 30 has a forwardly facing back wall 31 and upper and lower side walls 32 and 33. On the upper and lower side walls are two laterally spaced semi-circular flanges 34, 35, which may be part of bushings 36 (shown in detail in FIGS. 4 and 5). Suitable fasteners 37 may be provided on the outer sides 38 of the bushings (see FIG. 5) that may be snap fitted into holes 39 drilled or otherwise formed in the upper and lower side walls of the channels (see FIG. 3) to retain the bushings in place as shown in FIG. 2. Alternatively the semi-circular flanges 34', 35' may be formed by molding under-cuts 40 in the upper and lower side walls of the channels 30' as schematically shown in FIGS. 17 and 18. An advantage in making the semi-circular flanges part of bushings is that the bushings may be injection molded out of a much stronger plastic material such as nylon and the flanges may have a greater wall thickness than if integrally molded as part of the uprights.

Figure 6:
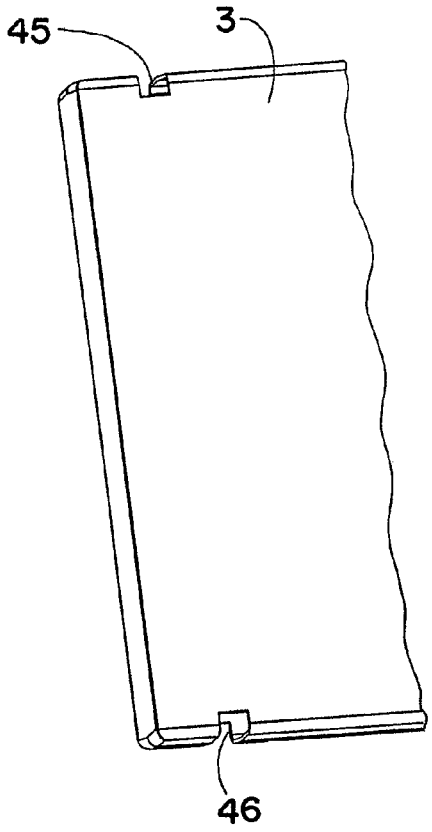
FIG. 6 is an enlarged fragmentary perspective view of an end portion of one of the guide rails of FIG. 1 that has aligned notches in the top and bottom edges of the guide rail in spaced relation from the end edge thereof.
Figure 10:
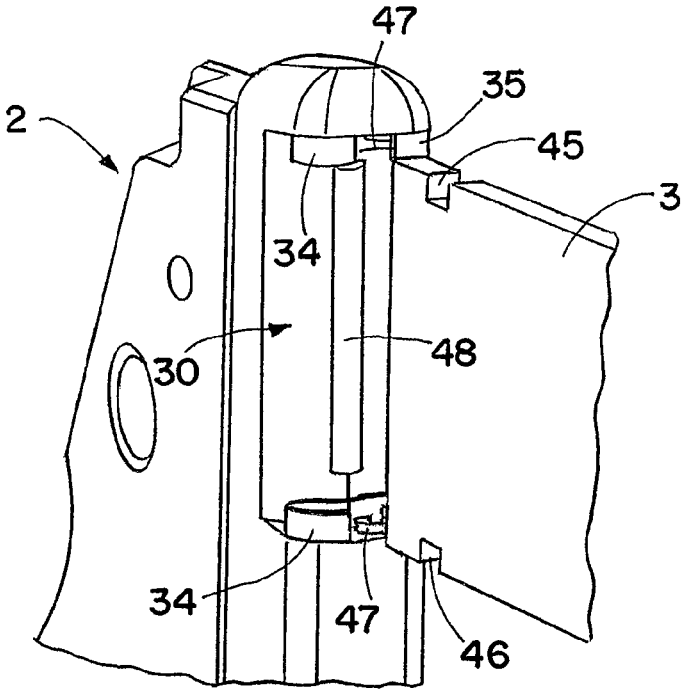
FIGS. 10-13 are enlarged fragmentary perspective views showing in sequence how a guide rail may be hingedly connected to an upright in accordance with the present invention without the use of any hand tools or fasteners.
Figure 11:
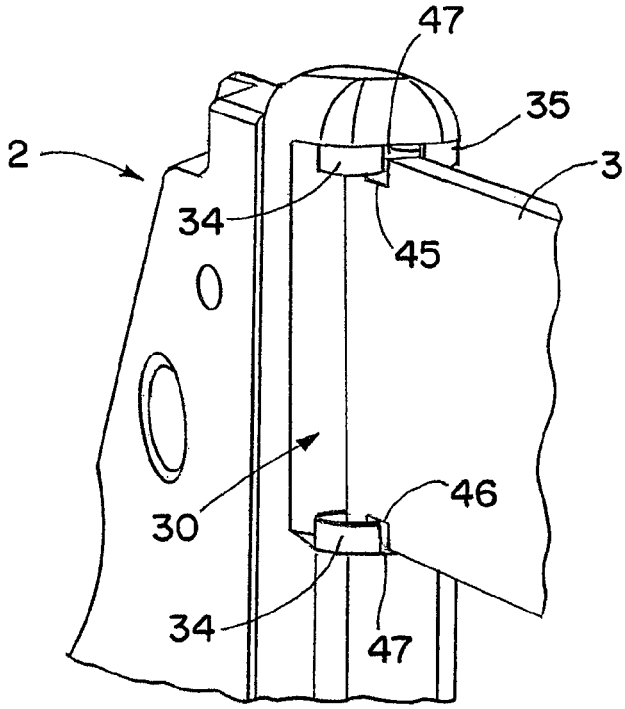
Figure 12:
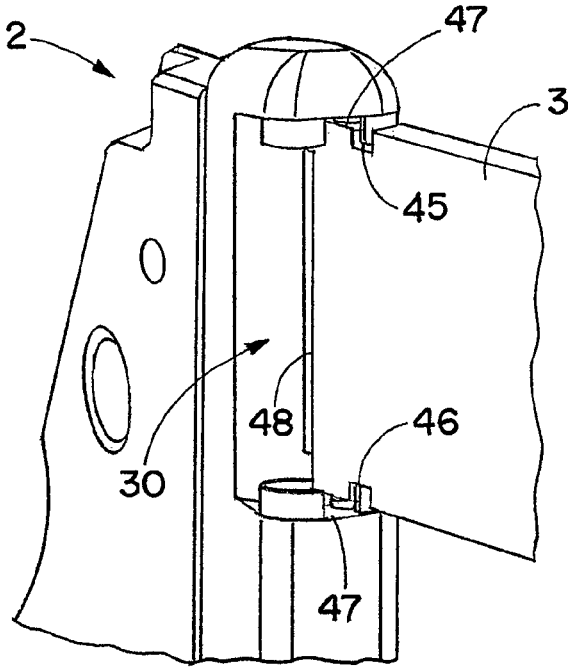
Figure 13:
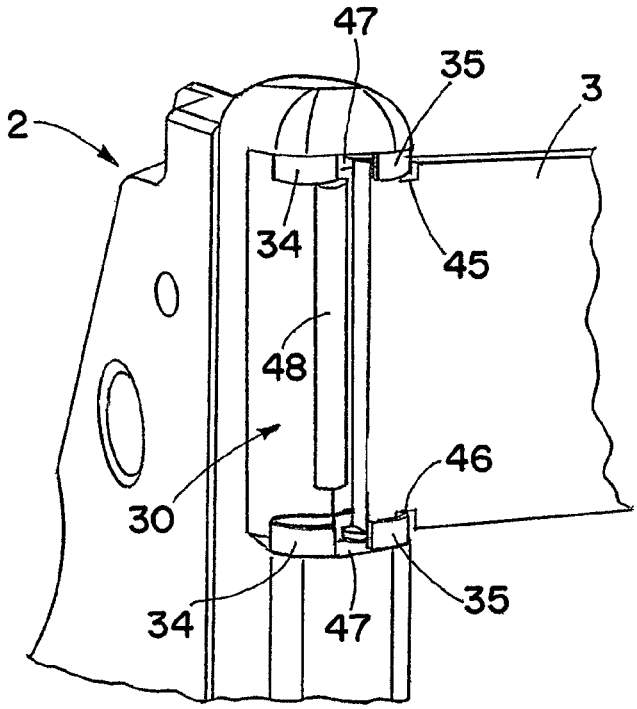

Regardless of how the semi-circular flanges may be provided on the upper and lower side walls of the channels, the flanges may be slidably engaged by upper and lower open notches 45, 46 of one or two guide rails 3 to hingedly connect one or two guide rails to the channels as described hereafter. FIG. 6 shows the open notches 45, 46 formed in the upper and lower edges of the guide rails 3 in spaced relation from the ends of the guide rails. The spacing between the notches and the end of the guide rails is desirably such that when the notched end of a guide rail is aligned with the gap 47 between the front portions of the spaced apart semi-circular flanges 34, 35 in the upper and lower side walls of a channel as shown in FIG. 10, and then inserted into the gap substantially flush up against a stop 48 at the back of the channel as shown in FIG. 11, the upper and lower notches 45, 46 will be in substantial alignment with the front portions of the semi-circular flanges. This allows for easy lateral movement of the end of the guide rail in either direction to engage one or the other pair of flanges as schematically shown in FIG. 12, and then rotate the guide rail approximately 90° relative to the upright in the direction away from the gap as shown in FIG. 13. This hingedly connects the guide rail to the upright without the need for any tools or fasteners.

Each of the semi-circular flanges 34, 35 defines a recess 50 sized to receive the end portions of the guide rails extending axially beyond the notches. At the entry points to the recesses there may be raised ribs 51 (see FIG. 4) to provide some resistance to insertion and removal of the end portions of the guide rails into and out of the recesses.

If both upper and lower guide rails are to be attached to an upright, it is desirable to attach the lower guide rail first and then attach the upper guide rail, since attaching the lower guide rail first will help stabilize the upright during attachment of the upper guide rail.

To attach the other ends of the guide rails to a second upright, the second upright is aligned with the respective guide rails and the guide rails are inserted into the gaps 47 between the front portions of the semi-circular flanges as before, beginning with the lower guide rail. Then the ends of the guide rails are moved laterally to engage the notches with the respective semi-circular flanges and the second upright is rotated substantially 90° relative to the guide rails to lock the guide rails in the second upright.

Figure 14:
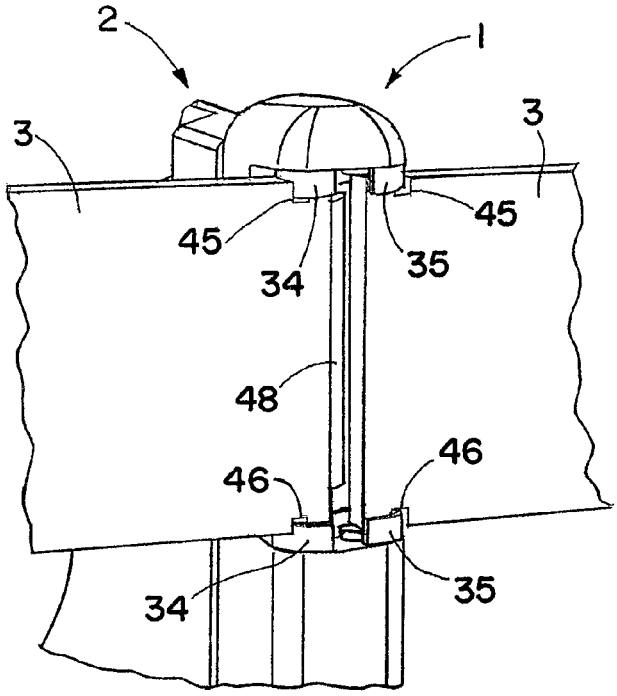
FIG. 14 is an enlarged fragmentary perspective view showing two guide rails hingedly connected to a single channel in one of the uprights.
Figure 15:
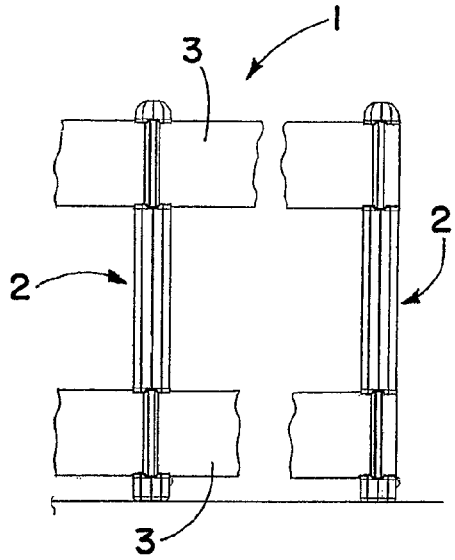
FIG. 15 is a fragmentary front elevation view of a pedestrian barricade assembly of the present invention in which two upper and two lower guide rails are shown hingedly connected to two uprights.

To attach other guide rails to the second upright, the ends of the other guide rails are aligned with the second upright, beginning with the lower guide rail, and inserted into the gaps between the front portions of the semi-circular flanges as before. Then the ends of the guide rails are moved laterally to engage the notches with the other pair of semi-circular flanges, and the other guide rails are rotated in a direction away from the gaps to lock the other guide rails in place as shown in FIG. 14. This same process may be followed for hingedly attaching as many uprights and guide rails together as needed for a particular application.

Figure 7:
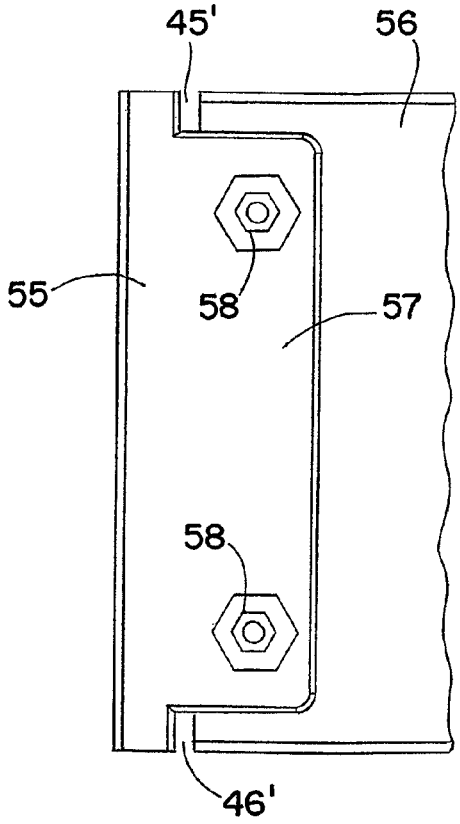
FIG. 7 is an enlarged fragmentary side elevation view of an end portion of another guide rail that has a bracket attached thereto to provide the end notches adjacent the end of the guide rail.
Figure 8:
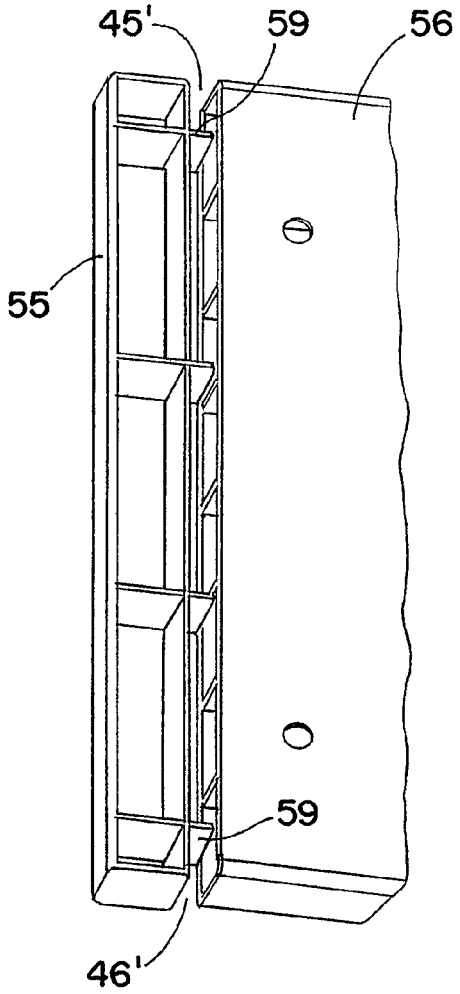
FIG. 8 is an enlarged fragmentary perspective view of the guide rail and bracket of FIG. 7 as viewed from the opposite side thereof.
Figure 9:
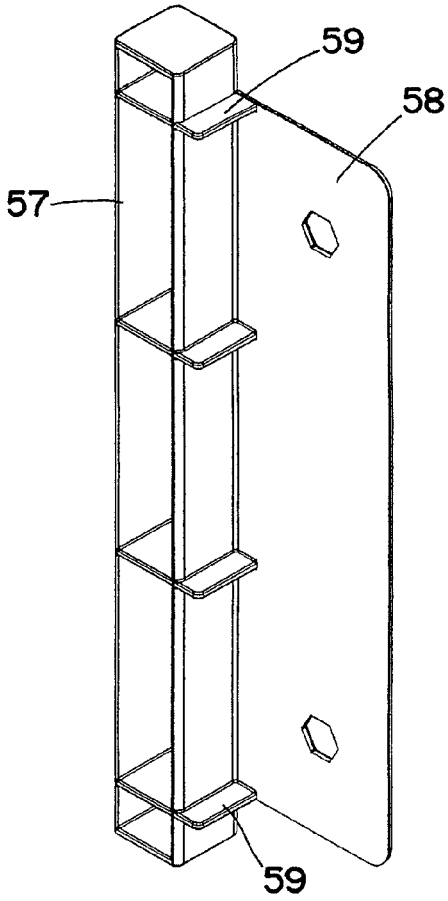
FIG. 9 is an enlarged perspective view of the bracket of FIG. 8 by itself.

Conventional guide rails without appropriately located end notches may also be used in the pedestrian barricade assembly of the present invention as by attaching brackets to the guide rails in axially spaced relation from the ends of the guide rails a distance substantially corresponding to the width of the notches 45, 46. One such bracket 55 is shown in FIGS. 7 and 8 attached to an end of a conventional guide rail 56 as by a mounting flange 57 that extends in parallel relation from one side of the bracket into overlying relation with one side of the guide rail and is secured thereto using suitable fasteners 58 of any desired type. The height of the mounting flanges 57 should be sufficiently less than the height of the brackets so as not to interfere with the formation of the notches 45', 46' between the brackets and the ends of the guide rails when the brackets are securely fastened to the guide rails. Also the brackets 55 desirably have two or more tabs 59 along the rearwardly facing end of the brackets (see FIG. 9) that engage the ends of the guide rails to maintain the desired spacing between the brackets and guide rails as schematically shown in FIG. 8.

The length of the brackets should be such that when the guide rails are aligned with the uprights and the brackets are inserted into the gaps between the semi-circular flanges flush up against the stops at the back of the channels, the notches 45', 46' formed by the spacing between the brackets and the ends of the guide rails will be in position for sliding engagement with one or the other of the pairs of upper and lower semi-circular flanges and rotation of the guide rails relative to the uprights in a direction away from the gaps to provide hinge connections therebetween in the manner previously described.

Although the height of the guide rails and uprights may vary within certain limits, the top guide rails should preferably be no lower than approximately 32 inches above the ground, and the bottom guide rails should preferably be no more than approximately 2 inches above the ground.

The number of uprights and number and length of guide rails used in a given pedestrian barricade assembly may vary depending on the size and shape of the construction or work area to be connected by a given assembly. For example, the guide rails may have lengths of 4 feet, 6 feet or 8 feet or even longer if desired. Also, the guide rails between adjacent pairs of uprights may be rotated anywhere between approximately 30° and approximately 145° away from the approximate center of the uprights to provide a continuous pedestrian barricade assembly extending in different directions depending on the shape of the construction or work area. See, for example, FIG. 1 which shows the guide rails running in three different directions.

However, the guide rails should not be moved to a position much closer than 30° away from the perpendicular to the front section of the uprights (except during assembly and disassembly of the guide rails from the uprights) since this may result in the guide rails inadvertently becoming disengaged from the uprights.

Although the invention has been shown and described with respect to certain embodiments, it is obvious that equivalent alterations and modifications will occur to others skilled in the art upon the reading and understanding of the specification. In particular, with regard to various functions performed by the above-described components, the terms (including any reference to a "means" used to describe such components) are intended to correspond, unless otherwise indicated, to any component which performs the specified function of the described component (e.g., that is functionally equivalent), even though not structurally equivalent to the disclosed component which performs the function in the herein exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A pedestrian barricade assembly comprising a plurality of uprights and associated guide rails, each guide rail having end portions that are hingedly connectable to the uprights, each upright including a front section having at least one channel extending transversely to a longitudinal axis of the front section, the channel of each upright having a forwardly facing back wall and upper and lower side walls, and upper and lower flanges extending partway around the respective upper and lower side walls, each of the guide rails having upper and lower open notches in axial spaced relation from the end portions of the guide rails, the upper and lower notches being transversely slidably engageable with the respective upper and lower flanges on the upper and lower side walls to provide hinge connections therebetween; and wherein each of the upper and lower flanges comprises a laterally spaced pair of semi-circular flanges on each of the upper and lower side walls, and the upper and lower notches of one or two of the guide rails are transversely slidably engageable with one or both of the semi-circular flanges of each pair on each of the upper and lower side walls to provide one or two hinge connections therebetween.

2. The assembly of claim 1 wherein there is a gap between front portions of each pair of semi-circular flanges on each of the upper and lower side walls to permit insertion of the end portions of the guide rails between each pair of semi-circular flanges for transverse sliding engagement of the upper and lower notches of the guide rails with either of the upper and lower semi-circular flanges of each pair and rotation of the guide rails in a direction away from the gap to hingedly connect the end portions of the guide rails to the respective uprights.

3. The assembly of claim 1 wherein the semi-circular flanges are part of respective bushings that are fixedly attached to the respective upper and lower side walls of the channel.

4. The assembly of claim 3 wherein the bushings have fasteners that are snap fitted into holes in the respective upper and lower side walls of the channel of each upright to retain the respective bushings in place.

5. The assembly of claim 4 wherein each of the semi-circular flanges defines a recess sized to receive the end portions of the guide rails extending axially beyond the respective upper and lower notches.

6. The assembly of claim 5 wherein the bushings have raised ribs at transverse entry points to the respective recesses to provide resistance to insertion and removal of the end portions of the guide rails extending axially beyond the respective upper and lower notches into and out of the respective recesses.

7. The assembly of claim 1 wherein the upper and lower semi-circular flanges are integral with the respective upper and lower side walls of the channel of the respective uprights.

8. The assembly of claim 7 wherein each of the upper and lower semi-circular flanges defines a recess sized to receive the end portions of the guide rails extending axially beyond the respective upper and lower notches.

9. The assembly of claim 8 wherein the upper and lower side walls of the channel of the respective uprights have raised transverse entry points to the respective recesses to provide resistance to insertion and removal of the end portions of the guide rails extending axially beyond the respective upper and lower notches into and out of the respective recesses.

10. The assembly of claim 1 wherein the upper and lower notches of two guide rails are transversely slidably engageable with different semi-circular flanges of each pair on each of the upper and lower side walls and rotatable in opposite directions away from a gap between the front portions of the semi-circular flanges of each pair to hingedly connect the end portions of the two guide rails to the respective uprights.

11. The assembly of claim 1 wherein each upright has two such transversely extending channels in vertically spaced relation from one another for hingedly connecting the end portions of guide rails in an uppermost channel of the respective uprights to provide the assembly with top guide rails and for hingedly connecting the end portions of other guide rails in a lowermost channel of the respective uprights to provide the assembly with bottom guide rails.

12. The assembly of claim 1 wherein the uprights are substantially in the shape of a right triangle, each upright including the front section which is substantially vertical when the guide rails are hingedly connected to the front section, and a rear section extending rearwardly from the front section.

13. The assembly of claim 12 wherein when the front section of each upright is substantially vertical, the rear section of each upright includes a substantially vertical leg portion, a substantially horizontal lower leg portion, and a rearwardly sloping leg portion, the leg portions being hollow for receipt of flowable ballast material through a fill hole in an upper portion of the rear section.

14. The assembly of claim 13 wherein the rearwardly sloping leg portion of each upright has a larger volume lower portion than the upper portion of each upright for receipt of more ballast material than the upper portion to provide a lower center of gravity for each upright.

15. The assembly of claim 13 wherein the horizontal lower leg portion of each upright has two axially spaced apart downwardly protruding ground pressure contact points that provide greater stability with the ground when the front section of each upright is vertical.

16. The assembly of claim 13 wherein the rear section of each upright has a substantially right triangular shaped through opening sized for receipt of a sandbag for ballasting each upright.

17. The assembly of claim 1 wherein the upper and lower notches are in upper and lower edges of respective guide rails.

18. The assembly of claim 1 wherein the upper and lower notches in respective guide rails are formed by brackets that are attached to the respective guide rails in axially spaced relation from the ends of the respective guide rails a distance corresponding to a spacing between opposite sides of the notches.

19. The assembly of claim 18 wherein the brackets are attached to the respective guide rails by mounting flanges that extend in parallel relation from one side of the brackets into overlying relation to one side of the respective guide rails, the mounting flanges having a height substantially less than the height of the brackets, and the brackets having two or more tabs on an end of the brackets that engages the ends of the respective guide rails to maintain the desired spacing between the brackets and respective guide rails.

* * * * *